US011655514B2

(12) United States Patent
Yuan et al.

(10) Patent No.: US 11,655,514 B2
(45) Date of Patent: May 23, 2023

(54) DEEPLY-HARDENED-SURFACE TURNOUT RAIL WITH HIGH DEGREE OF UNDERCOOLING AND THE PREPARATION METHOD THEREOF

(71) Applicant: PANGANG GROUP PANZHIHUA IRON & STEEL RESEARCH INSTITUTE CO., LTD., Panzhihua (CN)

(72) Inventors: Jun Yuan, Panzhihua (CN); Ming Zou, Panzhihua (CN); Yong Deng, Panzhihua (CN); Ruoxi Li, Panzhihua (CN)

(73) Assignee: PANGANG GROUP PANZHIHUA IRON & STEEL RESEARCH INSTITUTE CO., LTD., Panzhihua (CN)

( * ) Notice: Subject to any disclaimer, the term of this patent is extended or adjusted under 35 U.S.C. 154(b) by 0 days.

(21) Appl. No.: 17/509,375

(22) Filed: Oct. 25, 2021

(65) Prior Publication Data

US 2022/0127689 A1 Apr. 28, 2022

(30) Foreign Application Priority Data

Oct. 27, 2020 (CN) ..... 202011164327.4

(51) Int. Cl.
*C21D 9/04* (2006.01)
*C22C 38/24* (2006.01)
(Continued)

(52) U.S. Cl.
CPC ..... *C21D 9/04* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2016/0010188 A1* 1/2016 Han ..... C22C 38/02 148/333

FOREIGN PATENT DOCUMENTS

CN 104087836 A 10/2014
CN 111719083 A * 9/2020 ..... C21C 7/0087

OTHER PUBLICATIONS

Kopeliovich, Dmitri. "Ladle Refining." SubsTech Substances Technologies, 2012, https://www.substech.com/dokuwiki/doku.php?id=ladle_refining. (Year: 2012).*
(Continued)

*Primary Examiner* — Anthony M Liang
(74) *Attorney, Agent, or Firm* — Caesar Rivise, PC

(57) ABSTRACT

The invention relates to a turnout rail production technology, in particular to a deeply-hardened-surface turnout rail with high degree of undercooling and the preparation method thereof. The invention aims to solve the technical problem by providing a deeply-hardened-surface turnout rail with high degree of undercooling featured in even hardness distribution and a deeply hardened surface layer and the preparation method thereof. The method is described as follows: feeding molten iron for converter smelting→furnace rear argon blowing station→LF refining→RH vacuumization→casting steel blanks→slow cooling in the slow cooling pit→austenitic homogenization→rail rolling→heat treatment; in the converter smelting process, adding 0.2-0.3% Cr, 0.04-0.06 V and 0.75-0.80% C; the heat treatment process is divided into two cooling stages. The turnout rail prepared with the method described in the invention has a deeper deeply-hardened surface layer; the hardness is dis-
(Continued)

tributed more evenly, the anti-contact fatigue performance is higher and the resistance to wearing is ideal.

5 Claims, 1 Drawing Sheet

(51) Int. Cl.

| | |
|---|---|
| ***C22C 38/04*** | (2006.01) |
| ***C22C 38/02*** | (2006.01) |
| ***C22C 38/00*** | (2006.01) |
| ***C21D 8/00*** | (2006.01) |
| ***C21D 6/00*** | (2006.01) |

(52) U.S. Cl.
CPC ..... *C21D 8/005* (2013.01); *C22C 38/002* (2013.01); *C22C 38/02* (2013.01); *C22C 38/04* (2013.01); *C22C 38/24* (2013.01); *C21D 2211/001* (2013.01)

(56) References Cited

OTHER PUBLICATIONS

Weng, Yuqing, et al. "Pangang Rail Production System Innovation." Advanced Steels the Recent Scenario in Steel Science and Technology, Springer, Berlin, 2011, pp. 503-503. (Year: 2011).*

* cited by examiner

DEEPLY-HARDENED-SURFACE TURNOUT RAIL WITH HIGH DEGREE OF UNDERCOOLING AND THE PREPARATION METHOD THEREOF

CROSS-REFERENCE TO RELATED APPLICATIONS

This application claims priority from CN 202011164327.4, filed Oct. 27, 2020, the contents of which are incorporated herein by reference in their entireties.

FIELD OF INVENTION

The invention relates to a turnout rail production technology, in particular to a deeply-hardened-surface turnout rail with high degree of undercooling and the preparation method thereof.

BACKGROUND OF THE INVENTION

Turnouts are the key components and core hubs for railway track connection and train guiding, which must be comprehensively updated and upgraded in a new railway operation environment characterized by high speed and heavy load. One of the prime tasks is to develop the rails, the key base material, for manufacturing turnouts.

The quality of turnouts of high-speed railways is essential to train operation speed and safety. For the moment, prominent problems exist in turnout production: insufficient transition between switch rails and nose rails, excessive displacement and high transition resistance. Great efforts must be put into the research and development of turnout rails to meet the urgent demand for high-speed turnout rails as a result of the development of high-speed railways in China.

Due to the extremely unfavorable operational conditions for turnouts as a result of heavy axle loads, high traffic density and heavy traffic flows of heavy-loaded railways, the turnouts of heavy-loaded railways are worn and damaged much faster and more severe than those of the same type used for ordinary railways, which must be replaced frequently. The frequent replacement of turnouts not only increase the maintenance workload and cost of railway administrations, but also create potential risks for operation safety. In addition to manufacturing processes, the operation performance of turnouts mainly depends on the performance of turnout rails. Currently, either at home or abroad, the turnouts of heavy-loaded railways are mostly hot-rolled supplied in an air-cooled state, which are cut, milled and heat-treated at turnout factories.

With the adoption of the secondary-heating off-line heat treatment process, the rail head surface layer is hardened rather shallow, and, with the increment in depth, the hardness is reduced faster. In operation, pre-mature wearing and defects due to contact fatigue can occur easily; meanwhile, bending is a common phenomenon during the heat treatment on turnout rails, leading to less guaranteed straightness along the full length of rail; moreover, this process also significantly increases energy consumption, reduces the efficiency in turnout production and produces environmental pollution. As a result, it has become an urgent demand to research and develop a high-performance turnout rail which is featured in higher ductility, longer service life, environmental protection and energy conservation.

Turnout rails, especially switch rails, are often machined into extremely thin points at the end of a transfer track. To guarantee safety and durability of turnout rails, the surface layer is usually hardened to a required depth and gradient. Therefore, the ordinary carbon steel turnout rails produced by adopting the existing process can hardly meet the demand for developing heavy-loaded railways at home and abroad, and a deeply-hardened-surface turnout rail with high degree of undercooling and a preparation method are urgently needed.

BRIEF SUMMARY OF THE INVENTION

The invention aims to solve the technical problem by providing a deeply-hardened-surface turnout rail with high degree of undercooling featured in even hardness distribution and a deeply hardened surface layer and the preparation method thereof.

The invention provides a method for preparing a deeply-hardened-surface turnout rail with high degree of undercooling in the technical solution formulated to solve the above problems. The method comprises the following steps:

Feeding molten iron for converter smelting→furnace rear argon blowing station→LF (Ladle Furnace) refining→RH (Ruhrstahl-Heraeus) vacuumization→casting steel blanks→slow cooling in the slow cooling pit→austenitic homogenization→rail rolling→heat treatment; in the converter smelting process, adding 0.2-0.3% Cr, 0.04-0.06 V and 0.75-0.80% C; the heat treatment process is divided into two cooling stages.

Wherein, according to the method for preparing a deeply-hardened-surface turnout rail with high degree of undercooling, the temperature for austenitic homogenization is 1,000° C.-1,300° C. and the duration is 200-500 minutes.

Further, the total deformation during rolling is 85-95%.

Further, the heat treatment process includes the step of treating the rolled rail in the heat treatment unit with the residual heat; the temperature when feeding into the heat treatment unit is 800-850° C.

Further, the heat treatment process lasts for 110 seconds; for the first 80 seconds after the rolled rail is fed into the heat treatment unit, the rolled rail is cooled at a speed of 3-5° C./s; for the last 30 seconds, the rolled rail is cooled at a speed of 0.5-2° C./s.

Further, the medium used for cooling in the heat treatment process is compressed air or a mixture of water and air; if the cooling medium is a mixture of air and water, the air-to-water compression ratio is ≤1:3.

Further, after heat treatment, the rail is naturally cooled down to a temperature below 100° C. and then straightened by vertical and horizontal straightening machines.

The invention also provides a deeply-hardened-surface turnout rail with high degree of undercooling prepared with said method.

Further, the chemical components (by weight percentage) of the deeply-hardened-surface turnout rail with high degree of undercooling are as follows: C0.75-0.80%, Si0.1-0.6%, Mn0.6-1.3%, P≤0.020%, S≤0.020%, Cr0.2-0.3%, V0.04-0.06%; the rest include Fe and unavoidable impurities.

The beneficial effects of the invention are:

In the invention, 0.2-0.3% Cr and 0.75-0.80% C are added into the smelting process to improve rail hardenability; 0.04-0.06% V is added into the process to evenly distribute rail hardness, resulting in higher anti-contact fatigue performance and better wearing performance. In addition, two-stage cooling is adopted in the invention to not only increase the degree of under cooling of turnout rails, but also significantly improve the deeply hardened surface layer. The turnout rail prepared with the method described in the invention meets HBW2-0.6*HBW3-0.4*HBW1>0, at the same time, the hardness difference between any two points at the three positions—HBW1, HBW2 and HBW3 is not more than 30 HBW, and the difference between surface hardness and the hardness measured at 30 mm below the surface layer ≤5HRC; compared with the ordinary rolled carbon steel heat-treated turnout rails, it has a deeper deeply-hardened surface layer; the hardness is distributed more evenly, the anti-contact fatigue performance is higher and the resistance to wearing is ideal.

BRIEF DESCRIPTION OF THE DRAWINGS

The invention will be described in conjunction with the following drawings, wherein.

DETAILED DESCRIPTION OF THE PREFERRED EMBODIMENTS

Figure 1:
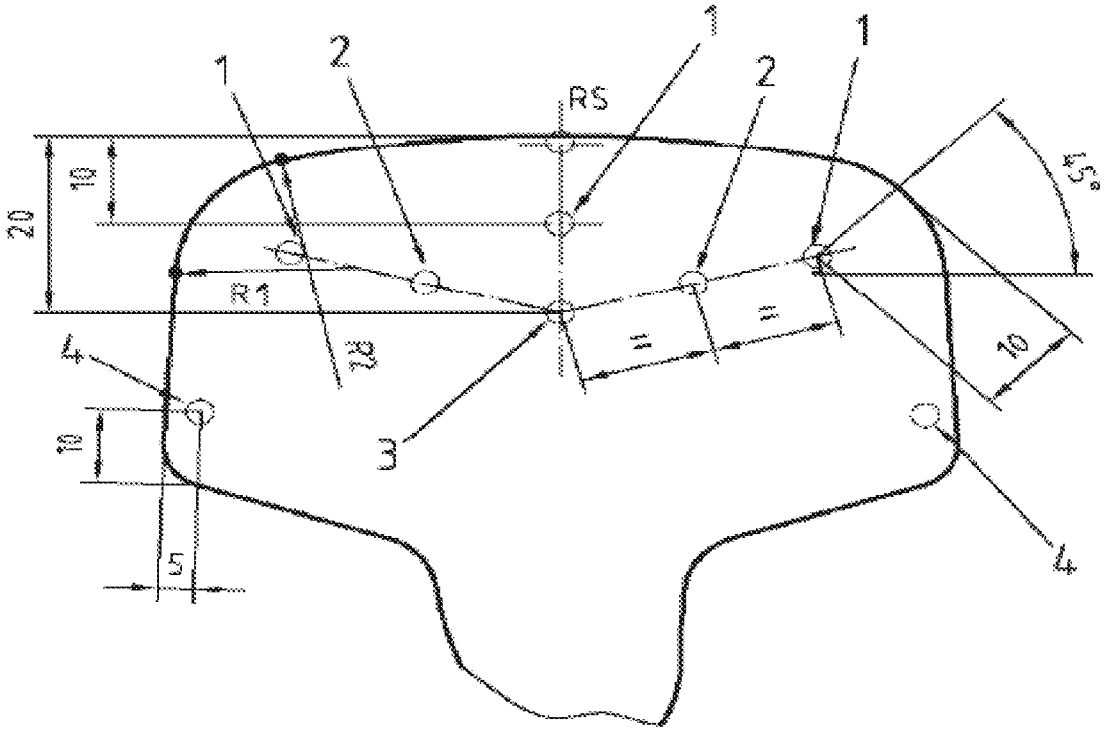
FIG. 1 shows the locations for hardness inspection of turnout rail section in embodiments and the comparative examples.
Figure 2:
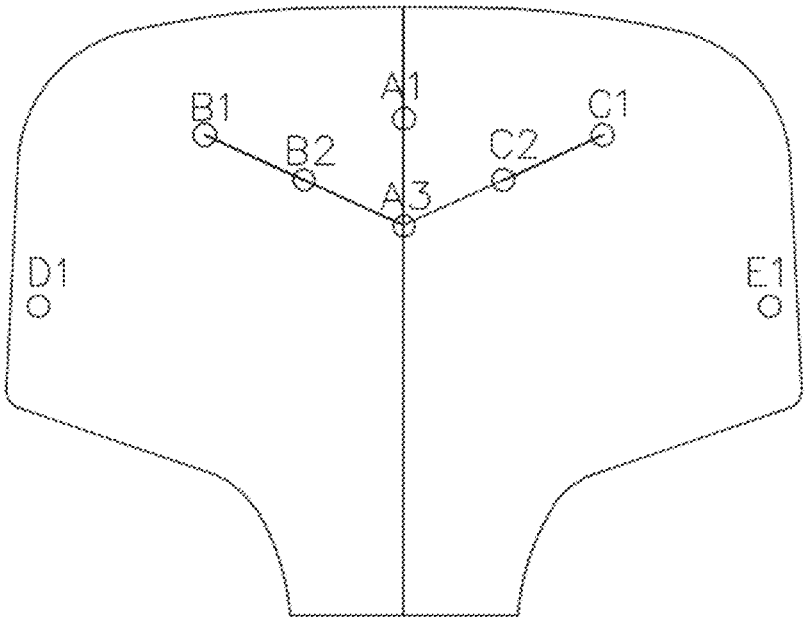
FIG. 2 shows the marks for the locations for hardness inspection of turnout rail section in embodiments and comparative examples.

In details, the invention provides a method for preparing a deeply-hardened-surface turnout rail with high degree of undercooling. The method comprises the following steps:

Feeding molten iron for converter smelting→furnace rear argon blowing station→LF refining→RH vacuumization→casting steel blanks→slow cooling in the slow cooling pit→austenitic homogenization→rail rolling→heat treatment; in the converter smelting process, adding 0.2-0.3% Cr, 0.04-0.06 V and 0.75-0.80% C; the heat treatment process is divided into two cooling stages.

In the present invention, 0.75-0.80% C, 0.2-0.3% Cr and 0.04-0.06% V are added in the smelting process. Wherein, C and Cr are added to move the C curve rightwards and thus improve hardenability of the turnout rail. V is mainly for precipitation hardening so that the hardness is distributed more evenly at the rail head, the anti-contact fatigue performance is better and the resistance to wearing is ideal.

In the invention, the temperature for austenitic homogenization is 1,000° C.-1,300° C. and the duration is 200-500 minutes. The purpose is to allow large and uniform original austenitic grain size, promote homogenization of components and guarantee evenness and controllability of the pearlite structure after rail rolling and heat treatment.

In the invention, the heat treatment process includes two-stage cooling: the entire heat treatment process takes 110 seconds.

Stage 1 (pre-phase change): due to a unit weight greater than 60 kg/m, the rail web of a turnout rail is about twice that of an ordinary symmetric rail. As a result, the rolled turnout rail has a high heat capacity, with the rail surface temperature as high as 900-1,000° C. High finishing rolling temperature results in that the degree of undercooling cannot be further increased and the heat at the center of rail head cannot be dissipated in the follow-up heat treatment process.

Therefore, in stage 1, forced cooling is conducted on the rolled turnout rail. That is, for the first 80 seconds after the rolled rail is fed into the heat treatment unit, cooling is performed at a speed of 3-5° C./s, with the purpose of increase the degree of undercooling, reduce heat capacity at the center of the rail, increase the phase change drive force at the center and improve center hardness. When cooling in stage 1 is too slow, the ideal cooling effect cannot be achieved; when cooling is too fast, the rail surface is cooled too fast while the center cannot be cooled fast enough due to the high heat capacity, there will be significant transition in hardness gradient of the rail, and the expected even transition of hardness gradient cannot be achieved.

In stage 2, i.e. the last 30 seconds, cooling is performed at a speed of 0.5-2° C./s, both the surface and the center of the turnout rail are beyond the phase change point, in which case the cooling speed can be reduced accordingly for further dissipation of heat at the center.

The invention not only increases the degree of under cooling of turnout rails, but also significantly improves the deeply hardened surface layer. The prepared turnout rail shows significant improvement in wearing performance and anti-contact fatigue performance.

The following embodiments are provided to further illustrate the invention.

TABLE 1

Chemical components (%) of the turnout rails in embodiments and comparative examples

| Item | Chemical elements (%) | | | | | | |
|---|---|---|---|---|---|---|---|
| | C | Si | Mn | P | S | Cr | V |
| Embodiment 1 | 0.75 | 0.10 | 0.62 | 0.010 | 0.010 | 0.21 | 0.04 |
| Embodiment 2 | 0.76 | 0.15 | 0.68 | 0.011 | 0.006 | 0.22 | 0.04 |
| Embodiment 3 | 0.76 | 0.20 | 0.76 | 0.013 | 0.005 | 0.22 | 0.04 |
| Embodiment 4 | 0.77 | 0.27 | 0.84 | 0.014 | 0.007 | 0.23 | 0.04 |
| Embodiment 5 | 0.79 | 0.32 | 0.92 | 0.015 | 0.008 | 0.23 | 0.05 |
| Embodiment 6 | 0.78 | 0.37 | 1.01 | 0.015 | 0.011 | 0.23 | 0.05 |
| Embodiment 7 | 0.79 | 0.42 | 1.10 | 0.013 | 0.013 | 0.24 | 0.06 |
| Embodiment 8 | 0.80 | 0.53 | 1.20 | 0.012 | 0.015 | 0.24 | 0.06 |
| Embodiment 9 | 0.80 | 0.59 | 1.29 | 0.011 | 0.011 | 0.25 | 0.06 |
| Comparative example 1 | 0.70 | 0.65 | 0.55 | 0.010 | 0.010 | 0.05 | 0.03 |
| Comparative example 2 | 0.77 | 0.34 | 1.01 | 0.015 | 0.009 | 0.23 | 0.03 |
| Comparative example 3 | 0.78 | 0.33 | 1.02 | 0.016 | 0.008 | 0.24 | 0.07 |
| Comparative example 4 | 0.79 | 0.35 | 1.03 | 0.014 | 0.007 | 0.25 | 0.07 |

TABLE 2

Treatment processes and structures in embodiments and comparative examples

| Item | Cooling speed in stage 1 (° C./s) | Cooling speed in stage 2 (° C./s) | Structure |
|---|---|---|---|
| Embodiment 1 | 3 | 0.5 | P |
| Embodiment 2 | 3 | 0.5 | P |
| Embodiment 3 | 3 | 0.5 | P |
| Embodiment 4 | 4 | 1 | P |
| Embodiment 5 | 4 | 1 | P |
| Embodiment 6 | 4 | 1 | P |
| Embodiment 7 | 5 | 2 | P |
| Embodiment 8 | 5 | 2 | P |
| Embodiment 9 | 5 | 2 | P |
| Comparative example 1 | 0 | 0 | P |
| Comparative example 2 | 2 | 0.3 | P |
| Comparative example 3 | 2.5 | 0.3 | P |
| Comparative example 4 | 6 | 3 | M |

The rest process parameters are the same for embodiments and comparative examples.

Samples are taken from rail sections for hardness testing as shown in the drawings. See table 3 for details.

TABLE 3

Hardness inspection in embodiments and comparative examples

| Item | Section hardness (HBW 2.5/187.5) | | | | | | | | | | | | |
|---|---|---|---|---|---|---|---|---|---|---|---|---|---|
| | A1 | A3 | B1 | B2 | C1 | C2 | D1 | E1 | HBW 1 | HBW 2 | HBW 3 | Range | Formula Result |
| Embodiment 1 | 321 | 316 | 318 | 315 | 319 | 320 | 319 | 319 | 319.3 | 317.5 | 316.0 | 6 | 0.17 |
| Embodiment 2 | 322 | 317 | 319 | 319 | 319 | 320 | 320 | 320 | 320.0 | 319.5 | 317.0 | 5 | 1.30 |
| Embodiment 3 | 325 | 320 | 322 | 321 | 322 | 322 | 323 | 323 | 323.0 | 321.5 | 320.0 | 5 | 0.30 |
| Embodiment 4 | 351 | 353 | 351 | 354 | 350 | 353 | 348 | 350 | 350.7 | 353.5 | 353.0 | 4 | 1.43 |
| Embodiment 5 | 353 | 355 | 355 | 356 | 352 | 355 | 351 | 353 | 353.3 | 355.5 | 355.0 | 4 | 1.17 |
| Embodiment 6 | 355 | 356 | 356 | 356 | 353 | 356 | 352 | 355 | 354.7 | 356.0 | 356.0 | 3 | 0.53 |
| Embodiment 7 | 362 | 363 | 363 | 364 | 363 | 363 | 360 | 368 | 362.7 | 363.5 | 363.0 | 2 | 0.63 |
| Embodiment 8 | 365 | 365 | 365 | 364 | 365 | 367 | 362 | 360 | 365.0 | 365.5 | 365.0 | 3 | 0.50 |
| Embodiment 9 | 367 | 368 | 364 | 366 | 364 | 368 | 364 | 363 | 365.0 | 367.0 | 368.0 | 4 | 0.20 |
| Comparative example 1 | 315 | 316 | 314 | 313 | 312 | 313 | 310 | 310 | 313.7 | 313.0 | 316.0 | 6 | −2.07 |
| Comparative example 2 | 325 | 314 | 322 | 314 | 326 | 303 | 322 | 323 | 324.3 | 308.5 | 314.0 | 23 | −9.63 |
| Comparative example 3 | 336 | 326 | 333 | 315 | 334 | 334 | 333 | 334 | 334.3 | 324.5 | 326.0 | 21 | −4.83 |
| Comparative example 4 | 374 | 357 | 374 | 343 | 375 | 375 | 374 | 374 | 374.3 | 359.0 | 357.0 | 32 | −4.93 |

Table 3 shows that all embodiments meet HBW2-0.6*HBW3-0.4*HBW1>0, indicating that the hardness of the rail prepared with the method in the invention decreases uniformly from the surface to the center, and the hardness is greater at the depth.

Samples are respectively taken from the rail heads for wearing testing in embodiments and comparative examples. The results are given in table 4.

TABLE 4

Rail head wearing in embodiments and comparative examples in the invention

| Item | Test parameters | | |
|---|---|---|---|
| | Load (N) | Number of rotation (ten-thousand times) | Wearing loss (g) |
| Embodiment 1 | 980 | 10 | 0.27 |
| Embodiment 2 | 980 | 10 | 0.29 |
| Embodiment 3 | 980 | 10 | 0.28 |
| Embodiment 4 | 980 | 10 | 0.25 |
| Embodiment 5 | 980 | 10 | 0.23 |
| Embodiment 6 | 980 | 10 | 0.22 |
| Embodiment 7 | 980 | 10 | 0.21 |
| Embodiment 8 | 980 | 10 | 0.20 |
| Embodiment 9 | 980 | 10 | 0.19 |
| Comparative example 1 | 980 | 10 | 0.42 |
| Comparative example 2 | 980 | 10 | 0.38 |
| Comparative example 3 | 980 | 10 | 0.32 |
| Comparative example 4 | 980 | 10 | 0.22 |

Samples are respectively taken from the rail heads for contact fatigue testing in embodiments and comparative examples. The results are given in table 5.

TABLE 5

Contact fatigue of the rails in embodiments and comparative examples in the invention

| Item | Contact stress/MPa | Slip frequency/% | Rotation speed rpm | Contact fatigue/ten-thousand times |
|---|---|---|---|---|
| Embodiment 1 | 1,350 | 5 | 1,000 | 25 |
| Embodiment 2 | 1,350 | 5 | 1,000 | 26 |
| Embodiment 3 | 1,350 | 5 | 1,000 | 27 |
| Embodiment 4 | 1,350 | 5 | 1,000 | 42 |
| Embodiment 5 | 1,350 | 5 | 1,000 | 43 |
| Embodiment 6 | 1,350 | 5 | 1,000 | 44 |
| Embodiment 7 | 1,350 | 5 | 1,000 | 45 |
| Embodiment 8 | 1,350 | 5 | 1,000 | 46 |
| Embodiment 9 | 1,350 | 5 | 1,000 | 47 |
| Comparative example 1 | 1,350 | 5 | 1,000 | 20 |
| Comparative example 2 | 1,350 | 5 | 1,000 | 21 |
| Comparative example 3 | 1,350 | 5 | 1,000 | 22 |
| Comparative example 4 | 1,350 | 5 | 1,000 | 23 |

According to above results, the method described in the invention can effectively increase the hardness of the deeply hardened surface layer and significantly improve the wearing performance and anti-contact fatigue performance of the rail. The turnout rail prepared with the method in the invention applies to heavy-loaded railways and high-speed railways with heavy axle loads and high density.

What is claimed is:

1. A method for preparing a hardened-surface turnout rail with a degree of undercooling, said method comprising the following sequential steps:

feeding molten iron for converter smelting;

blowing argon into the molten iron in a furnace rear argon blowing station;

LF refining;
RH vacuumization;
casting steel blanks;
cooling in a cooling pit;
austenitic homogenization;
rail rolling; and
heat treatment,
wherein: (a) 0.2-0.3 wt. % Cr, 0.04-0.06 wt % V and 0.75-0.80 wt % C are added to the molten iron during the converter smelting; (b) the heat treatment step is divided into two cooling stages; (c) the heat treatment step lasts for 110 seconds; and (d) for the first 80 seconds after a rolled rail is fed into a heat treatment unit, the rolled rail is cooled at a speed of 3-5° C./s; for the last 30 seconds, the rolled rail is cooled at a speed of 0.5-2° C./s.

2. The method according to claim 1, wherein the austenitic homogenization is conducted at a temperature of 1,000° C.-1,300° C. and for a duration of 200-500 minutes.

3. The method according to claim 1, wherein a total deformation during rolling is 85-95%.

4. The method according to claim 1, wherein the heat treatment step comprises treating a rolled rail in a heat treatment unit with residual heat; and a temperature when feeding the rolled rail into the heat treatment unit is 800-850° C.

5. The method according to claim 1, wherein, after heat treatment, the rail is naturally cooled down to a temperature below 100° C. and then straightened by vertical and horizontal straightening machines.

* * * * *